United States Patent [19]

Montgomery

[11] Patent Number: 4,900,589

[45] Date of Patent: Feb. 13, 1990

[54] GRANULE APPLICATION DEVICE AND PROCESS

[75] Inventor: Donald Montgomery, Mount Vernon, Ind.

[73] Assignee: GAF Building Materials Corporation, Wayne, N.J.

[21] Appl. No.: 241,284

[22] Filed: Sep. 7, 1988

[51] Int. Cl.[4] ..... B05D 1/12

[52] U.S. Cl. ..... 427/188; 427/187; 118/310; 118/312

[58] Field of Search ..... 427/188, 187, 186; 118/310, 312

[56] References Cited

U.S. PATENT DOCUMENTS

| | | | |
|---|---|---|---|
| 1,154,334 | 9/1915 | Overbury | 427/187 |
| 2,348,578 | 5/1944 | Soissa | 427/186 X |
| 2,661,303 | 12/1953 | Fasold et al. | 427/188 X |
| 3,132,964 | 5/1964 | Young | 427/188 |
| 3,184,324 | 5/1965 | Ryckman | 427/188 |
| 4,352,837 | 10/1982 | Kopenhauer | 427/188 X |
| 4,478,869 | 10/1984 | Brady et al. | 427/186 X |

*Primary Examiner*—Shrive Beck

*Attorney, Agent, or Firm*—Anthony Lagani, Jr.; Richard T. Laughlin; Joshua J. Ward

[57] ABSTRACT

A granule application device for use in making a shingle roofing product is provided. This device includes a sheet having a weather protected headlap area and having a weather exposed butt area which moves continuously from an upstream end to a downstream end. The device includes a blender applicator which dispenses blended butt granules on the sticky, asphalt treated, upper surface of the sheet for covering the butt area only. The device also includes a headlap applicator which dispenses less expensive headlap granules on the headlap area only. The device also includes a recycle applicator, which dispenses recycle granules over the blended granules on the butt area only, and dispenses scrap granules over the headlap area only. The moving sheet is supported on a talc drum and a slate drum near the downstream end, and is supported on a back roll near the upstream end thereof. The manual control of the dispensing of the less expensive headlap granules, and the overall arrangement, reduces the percentage of more expensive blended granules in the recycled granules, thereby minimizing the overall cost of the shingle roofing product.

8 Claims, 4 Drawing Sheets

GRANULE BIN ARRANGEMENT
TOP VIEW

GRANULE APPLICATION DEVICE AND PROCESS

The invention relates to a granule application device, and in particular the invention relates to a granule application device having three granule applicators for making shingle roofing products.

BACKGROUND OF THE INVENTION

The prior art granule application device is described in U.S. Pat. No. 4,478,869, issued Oct. 23, 1984. Related disclosures appear in U.S. Pat. Nos. 1,669,166, issued May 8, 1928; 2,111,565, issued Mar. 22, 1938; 2,160,787, issued May 30, 1939; 2,211,204, issued Aug. 13, 1940; 2,233,122, issued Feb. 25, 1941; 2,356,570, issued Aug. 22, 1944; 2,400,746, issued May 21, 1946; 2,661,303, issued Dec. 1, 1953; 3,132,964, issued May 12, 1964; 3,184,324, issued May 18, 1965; and 4,352,837, issued Oct. 5, 1982.

The prior art granule application devices generally include a blender applicator with a recycle applicator disposed immediately downstream of the applicator and a sheet for travelling under these applicators to receive the granules.

One of the basic problems with the prior art granule application device is that a substantial volume of expensive granules from the blender applicator have to be recycled into a recycle applicator from the travelling sheet.

SUMMARY OF THE INVENTION

According to the present invention, a granule application device is provided for applying granules to a travelling sheet which includes a blender applicator, a recycle applicator, a headlap applicator and a dispensing control disposed between the blender applicator and the recycle applicator.

The headlap applicator is arranged with a dispensing control between the blender applicator and the recycle applicator to minimize the recycle volume of the expensive granules from the blender applicator and for increasing the recycled volume of the less expensive granules from the headlap applicator. This arrangement avoids the problem of recycling a substantial volume of expensive granules from the blender applicator into the recycle applicator from the travelling sheet.

The foregoing and other objects, features and advantages of the invention will be apparent from the following detailed description of the preferred embodiment of the invention.

DESCRIPTION OF THE PREFERRED EMBODIMENT

Figure 1:
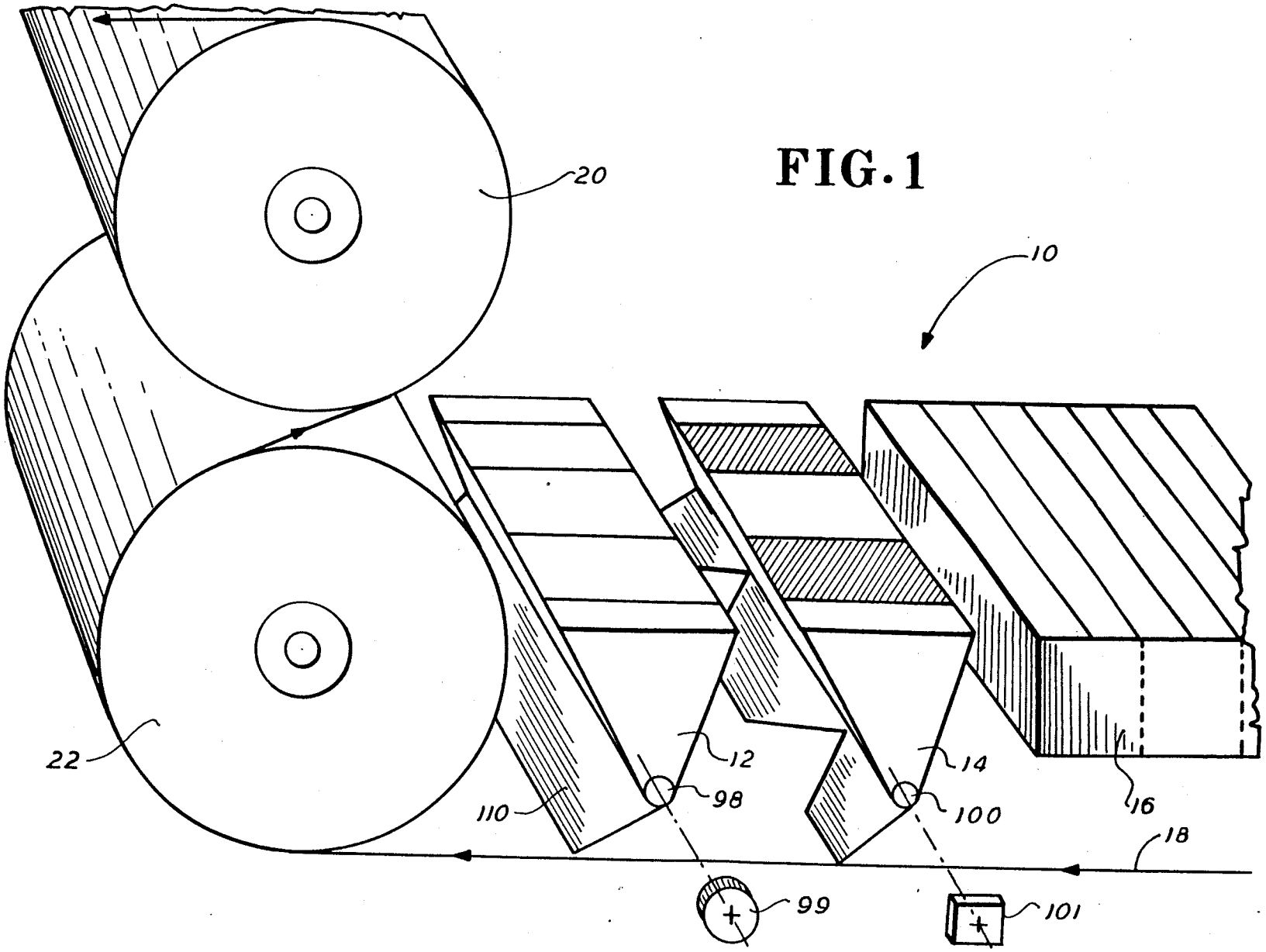
FIG. 1 is a schematic perspective view of a granule application device according to the invention.
Figure 2:
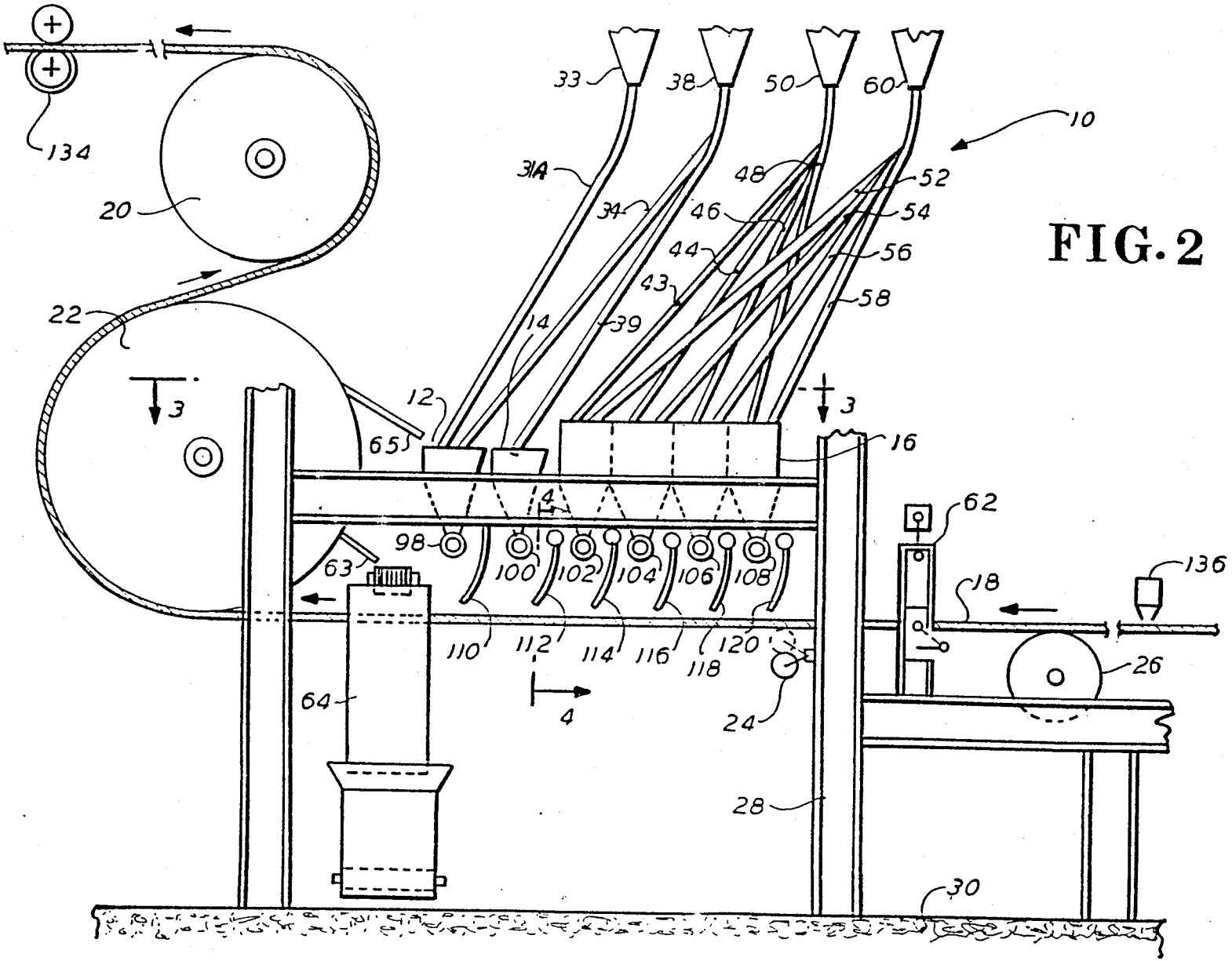
FIG. 2 is an elevation view of the granule application device of FIG. 1.

As shown in FIGS. 1 and 2 of the drawing, a granule application device for use in making a shingle roofing product is generally indicated at 10. The device includes a backfall or recycle applicator 12, a headlap applicator 14, a variegated or blender applicator 16. A web or sheet 18 travels under the applicators 12, 14 and 16 for receiving granules from the applicators.

FIG. 2 shows the sheet 18 supported by a talc drum or roll 20, a slate drum or roll 22, and a seal drum or roll 26. All the drums 20, 22 and 26 are mounted on a support structure 28, which rests on a concrete floor 30.

Figure 3:
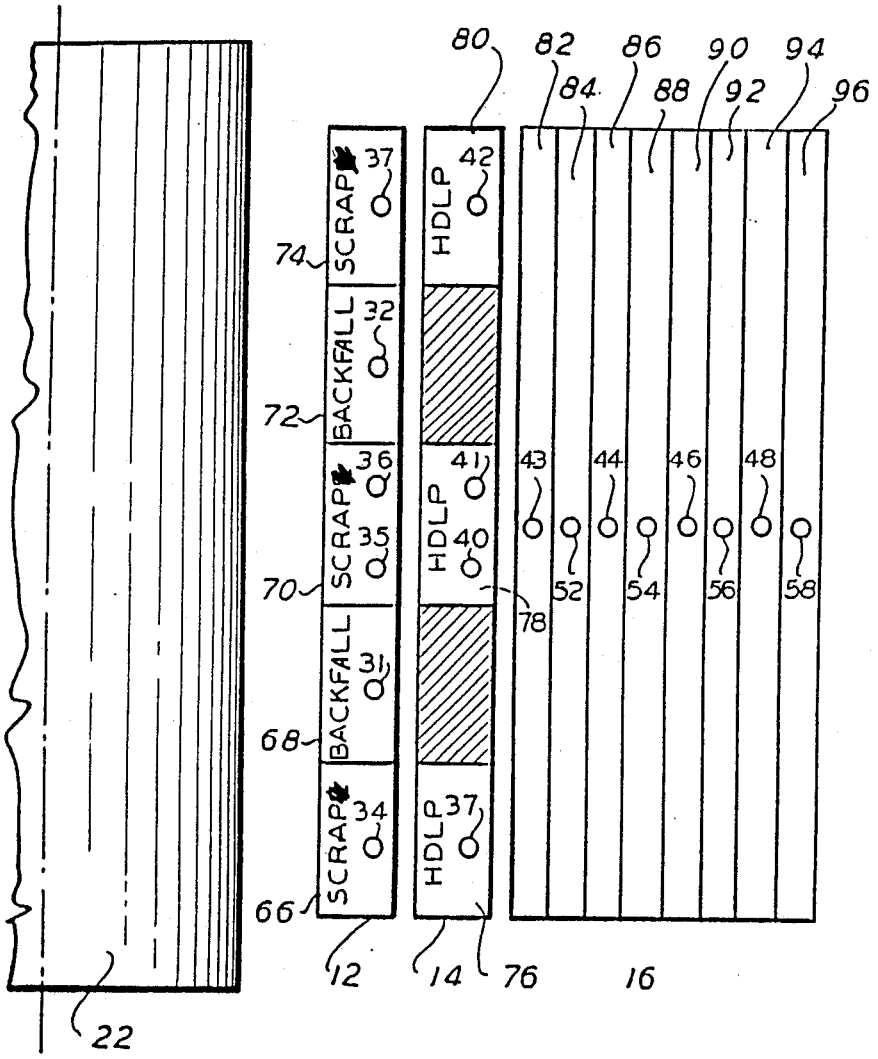
FIG. 3 is a section view taken along the line 3—3 of FIG. 2.
Figure 5:
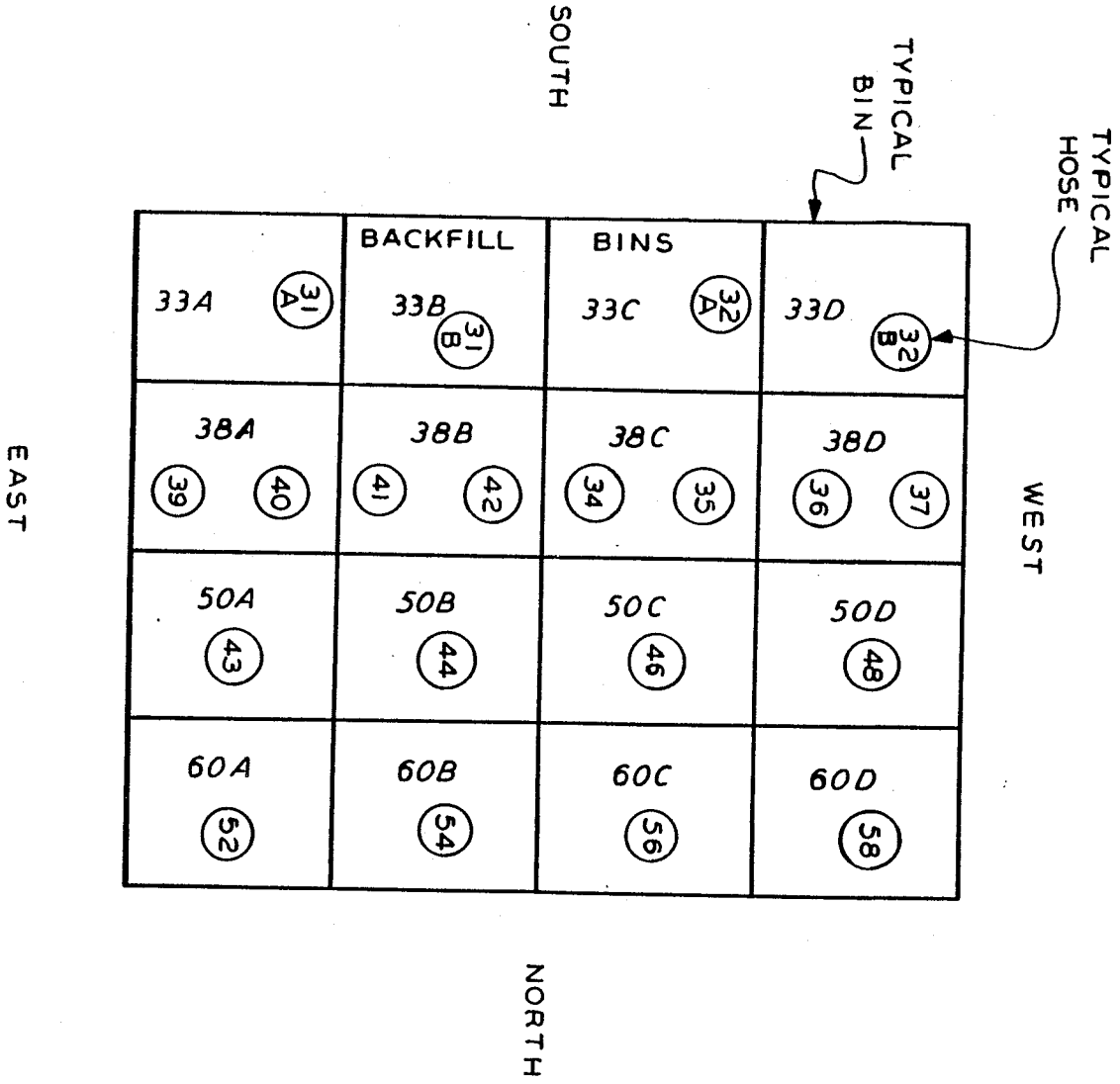
FIG. 5 is a top view of the granule bin arrangement.

Referring to FIGS. 2, 3 and 5, granules are fed from bins 33, 38, 50 and 60. Each bin is divided into sections or blender bins. The recycle applicator 12 is fed granules from bin 33 through drop tubes 31A, 31B, 32A and 32B located in backfall bins 33A through 33D. The recycle applicator 12 is also fed granules by drop tubes 34, 35, 36, 37 from scrap bins 38C and 38D. The headlap applicator 14 is fed by drop tubes 39, 40, 41, 42 from headlap bins 38A and 38B. The blender applicator 16 is fed by drop tubes 43, 44, 46, 48 from blender bins 50A through 50D. The blender applicator 16 is also fed by drop tubes 52, 54, 56, 58 from blender bins 60A through 60D.

As shown in FIG. 2, the granule application device 10 also has a seal back wiper 62, which is disposed adjacent to a seal roll 26 which can be used for applying a back coating. The granule application device 10 also has a recycle slate conveyor 64, which is disposed near to the recycle applicator 12 and the scrap bins 38C and 38D. The conveyor 64 has an input recycle chute 63. The recycle applicator 12 also has an input recycle chute 65.

In FIG. 3, recycle applicator 12 has compartments or chambers 66, 68, 70, 72, 74. The headlap applicator 14 has similar chambers 76, 78, 80. The blender applicator 16 also has similar chambers 82 84, 86, 88, 90, 92, 94, 96. In FIG. 2, the recycle applicator 12 has a machine driven roll and gate unit 98. The headlap applicator 14 has a manually operable roll and gate unit 100. The blender applicator 16 also has four machine driven roll and gate units 102, 104, 106, 108.

In FIG. 2, roll and gate units 98, 100, 102, 104, 106, 108 have respective adjacent deflector plates 110, 112, 114, 116, 118 and 120 for deflecting the granules during their fall.

The manually operable roll and gate unit 100 is a variable speed unit, and it is independent of the speed of a machine drive. The gate is opened by manual control.

The roll and gate unit 98 connects to a machine drive (not shown) by a varigator link unit 99. The roll and gate unit 100 has a manually operated D.C. control unit 101. The roll and gate units 102, 104, 106 and 108 are also mechanically linked to the machine (not shown), so that a speed change of sheet 18 will cause a proportional speed change in the flow of granules from the blender applicator 16, and from the recycle applicator 12. In this way, a respective constant thickness of granules are applied by the blender applicator 16 and by the recycle applicator 12 on sheet 18, regardless of the speed of travel of sheet 18.

Figure 4:
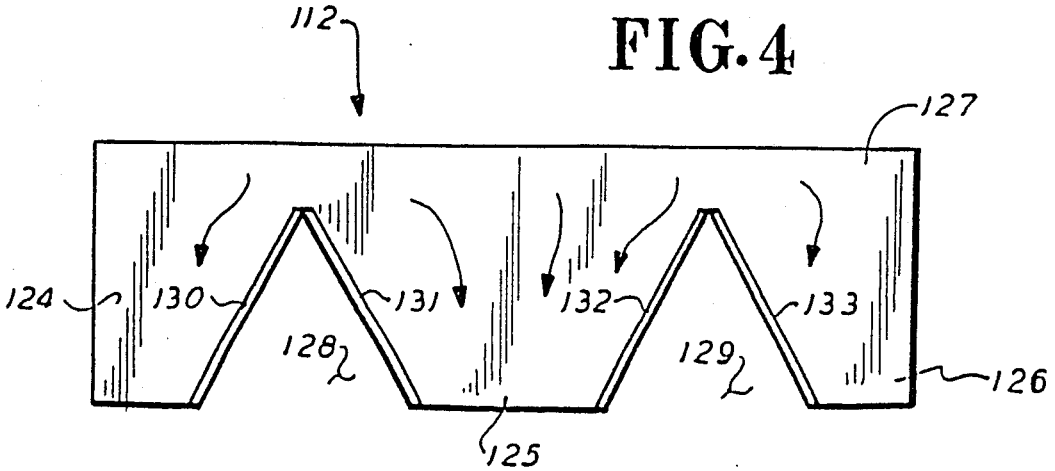
FIG. 4 is a section view taken along the line 4—4 of FIG. 2.

In FIG. 4, the deflector plate 112 of the headlap applicator 14 is shown. The plate 112 has three flat guide portions 124, 125, 126, a bent portion 127, two protected backfall zones 128, 129, and directional guides 130, 131, 132, 133.

In FIG. 2, the device 10 has a cutter unit 134, which is disposed downstream of drum 20. The device also has a coater assembly 136, which is disposed upstream of the roll 26. The cutter unit 134 cuts sheet 18 into pieces to form shingles. A coater assembly 136 applies a conventional sticky material, such as asphalt, to the facing surface of sheet 18 prior to the application of the granules.

In operation, the blender applicator 16 applies blended prime butt granules to the surface of the sheet 18 only in the exposed drop areas of the butt. The headlap applicator 14 then applies virgin granules to the headlap area which had not been exposed to the blender applicator. The backfall applicator 12 then applies a general coverage of granules across the entire surface of the sheet using a combination of recycled granules and virgin make-up granules. The backfall box of the backfall applicator is zoned so that the combined recycle headlap granules and virgin headlap granules are applied only in the headlap zones on the sheet.

The headlap applicator applies a thickness of less expensive headlap granules only on the non-exposed headlap area of the surface of the sheet; so that the headlap area of the surface of the sheet will ultimately have a double thickness of granules. The thickness of granules is adjusted by manual operation of control unit 101. The granules applied to the non-exposed headlap area of the sheet by means of the deflector plate 112 are applied in controlled distinctive lines.

The recycle applicator 12 applies a uniform thickness of granules to the surface of the sheet. In one embodiment of the invention, the sheet width is about forty eight inches, which includes two outer six inch wide headlap strips and one center twelve inch wide headlap strip and two intermediate twelve inch wide weather exposed butt strips, so that sheet can be cut along three cutting lines to form four longitudinal shingle strips. The recycle applicator 12, which is about forty eight inches wide, has two outer six inch wide chambers 66, 74 with recycle or scrap granules for the two outer six inch wide headlap strips. The recycle applicator 12 also has one center twelve inch wide chamber 70 with recycle or scrap granules for the one center 12 inch wide headlap strip. The recycle applicator 12 also has two intermediate twelve inch wide chambers 68, 72 with clean new backfall granules for the two intermediate twelve inch wide weather exposed butt strips.

The varigator link unit 99 is adjusted, to provide just slightly more new backfall granules to the exposed butt area than will be imbedded and accepted by the coated sheet 18.

A typical process of manufacture utilizing the granule application device 10 is as follows. A sticky, asphalt material is applied over the total facing area of sheet 18 by coater assembly 136. The blender applicator 16 dispenses blended granules over the butt area of sheet 18. The headlap applicator 14 then dispenses headlap granules over the headlap area of the sheet 18 at a rate of flow as set by an operator. The recycle applicator 12 dispenses recycled granules over the headlap granules and the butt (exposed) area on sheet 18. The blender applicator 16 and recycle applicator 12 are machine driven and dispense at a rate of flow in proportion to the rate of movement of sheet 18. Cutter unit 134 then cuts sheet 18 into elongate shingle strips by a peripheral blade, and into pieces by a transverse blade, at a rate in proportion to the speed of movement of sheet 18.

The advantages of the invention are indicated hereafter.

A. The total area available in the non-exposed headlap area is covered with less expensive headlap granules by the headlap applicator 14; and there is substantially no contamination of headlap granules in the exposed butt area.

B. Less expensive granules are applied twice to the non-exposed headlap area, in order to insure relative larger weight in the non-exposed headlap area.

C. By reducing the amount of granules applied to the exposed butt area, there is more enhancement of the blended granule drops in the exposed butt area and there is less contamination of headlap granule in the exposed butt area.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. A process for applying granules to a moving sheet having a headlap area and a butt area for making a shingle roofing product including:

applying a sticky material to the headlap area and the butt area of the moving sheet;

dispensing blended granules over the butt area at a rate in proportion to a rate of movement of the sheet;

dispensing headlap granules over the blended granules on the headlap area at a rate as set by an operator and independent of the rate of movement of the sheet;

dispensing recycled headlap granules over the headlap granules on the headlap area at a rate in proportion to the rate of movement of the sheet;

dispensing backfall granules over the blended granules on the butt area at a rate in proportion to the rate of movement of the sheet; and cutting the moving sheet into shingle pieces at a rate in proportion to the rate of movement of the sheet.

2. A granule application device comprising:

a sheet having a headlap area and a butt area for travelling from an upstream end thereof to a down stream end thereof;

a blender applicator disposed near the upstream end of the sheet for dispensing blended granules to the butt area;

a recycle applicator spaced from the blender applicator and disposed near the downstream end of the sheet for dispensing recycled granules to the headlap area and for dispensing backfall granules to the butt area; and a headlap applicator with a dispensing control disposed between the blender applicator and the recycle applicator for adjustably dispensing headlap granules to the headlap area, wherein the blender applicator has a first blender bin and a first blender chamber connected by a first drop tube and has a second blender bin and a second blender chamber connected by a second drop tube for dispensing blended granules on the butt area of the sheet, and wherein the sheet has a machine drive, and wherein the first blender chamber together with the second blender chamber has a blender machine driven roll and gate unit connected to said drive, and the recycle applicator has a recycle machine driven roll and gate unit connected to said drive, for dispensing the granules from the blender applicator and the recycle applicator at a speed of flow in proportion to the speed of the sheet, and wherein the headlap applicator with a dispensing control has a manually operated roll and gate unit for adjustably dispensing headlap granules on the headlap area of the sheet at a speed of flow as set by an operator.

3. The device of claim 2 including:

a talc drum and a slate drum disposed near the downstream end of the sheet for supporting the sheet;

a seal roll disposed near the upstream end of the sheet for supporting the sheet; and a support structure for supporting the talc drum and slate drum and seal roll.

4. The device of claim 1, wherein the recycle applicator has a headlap bin having a first plurality of headlap tubes and has a recycle bin having a second plurality of recycle tubes and has a first plurality of headlap chambers respectively connecting to the first plurality of headlap tubes and has a second plurality of recycle chambers respectively connecting to the second plurality of recycle tubes for dispensing recycle granules on the headlap area of the sheet and for dispensing backfall granules on the butt area of the sheet.

5. The device of claim 4, wherein the headlap applicator has a plurality of headlap tubes connecting to the headlap bin and has a plurality of chambers respectively connecting to its headlap tubes for dispensing headlap granules on the headlap area of the sheet.

6. The device of claim 5 including a recycle slate conveyor having an input recycle chute disposed adjacent to the slate drum for filling the recycle bin; and including a second recycle chute disposed adjacent to the slate drum for filling the recycle chambers of the recycle applicator.

7. The device of claim 2, wherein the headlap applicator has a deflector plate having guide portions with return bends for dispensing headlap granules in straight lines defining edges of the headlap area of the sheet.

8. The device of claim 2 including a coater assembly disposed upstream of the blender applicator, and including a cutting unit disposed downstream of the recycle applicator.

* * * * *